US007880074B2

(12) United States Patent
Baskerville

(10) Patent No.: US 7,880,074 B2
(45) Date of Patent: Feb. 1, 2011

(54) FLOOR COVERINGS TO BE PLACED UNDERNEATH DRUMS AND DRUMKITS

(76) Inventor: Ian Baskerville, 21 Wellington Road, St. Albans, Herts. AL1 5NJ (GB)

( * ) Notice: Subject to any disclaimer, the term of this patent is extended or adjusted under 35 U.S.C. 154(b) by 209 days.

(21) Appl. No.: 12/085,980

(22) PCT Filed: Nov. 30, 2006

(86) PCT No.: PCT/GB2006/004464

§ 371 (c)(1),
(2), (4) Date: Jun. 25, 2008

(87) PCT Pub. No.: WO2007/063303

PCT Pub. Date: Jun. 7, 2007

(65) Prior Publication Data

US 2009/0151539 A1 Jun. 18, 2009

(30) Foreign Application Priority Data

Dec. 3, 2005 (GB) ..... 0524736.6

(51) Int. Cl.
*G10D 13/02* (2006.01)

(52) U.S. Cl. ..... 84/421; 248/298.11

(58) Field of Classification Search ..... 84/421; 248/298.11
See application file for complete search history.

(56) References Cited

U.S. PATENT DOCUMENTS

| | | | | |
|---|---|---|---|---|
| 3,096,677 | A | 7/1963 | Ryan | |
| 4,185,808 | A * | 1/1980 | Donohoe et al. | 248/295.11 |
| 5,994,634 | A * | 11/1999 | Cady | 84/421 |
| 2005/0061138 | A1 | 3/2005 | Justis | |

FOREIGN PATENT DOCUMENTS

WO WO2006/014104 2/2006

* cited by examiner

*Primary Examiner*—Jianchun Qin
(74) *Attorney, Agent, or Firm*—James C. Wray; Meera P. Narasimhan

(57) ABSTRACT

Apparatus is provided for covering a floor in order to place a drum or a plurality of drums on the floor. The apparatus includes a flexible substrate having an upper surface and an under surface for covering a region of a floor onto which a drum is to be assembled such that a plurality of support feet contact the upper surface of the substrate and a plurality of rigid foot locators extending from the upper surface each at a desired location for a specific one of the support feet. The foot locators are secured firmly to the substrate without fixtures that protrude from the under surface, so as not to cause floor damage and the foot locators restrict movement of the support feet thereby restricting movement of a supported drum while the drum is being played.

13 Claims, 10 Drawing Sheets

FLOOR COVERINGS TO BE PLACED UNDERNEATH DRUMS AND DRUMKITS

This application claims the benefit of GB Application No. 0524736.6 filed Dec. 3, 2005 and PCT/GB2006/004464 filed Nov. 30, 2006, which are hereby incorporated by reference in their entirety.

BACKGROUND OF THE INVENTION

The present invention relates to floor coverings to be placed underneath drums and drum kits.

BRIEF SUMMARY OF THE INVENTION

According to an aspect of the present invention, there is provided apparatus for covering a floor in order to place a drum or a plurality of drums (a drum kit) on said floor, comprising a flexible substrate having an upper surface and an under surface for covering a region of a floor onto which a drum is to be assembled such that a plurality of support feet contact the upper surface of said substrate and a plurality of rigid foot locators extending from said upper surface, each at a desired location for a specific one of said support feet. Wherein said foot locators are secured firmly to the substrate without fixtures that protrude from said under surface so as not to cause floor damage and the foot locators restrict movement of the support feet, thereby restricting movement of a supported drum while said drum is being played.

BRIEF DESCRIPTION OF THE SEVERAL VIEWS OF THE DRAWINGS

FIG. 5 shows a cross section through a foot locator and the apparatus it fixes to;

WRITTEN DESCRIPTION OF THE BEST MODE FOR CARRYING OUT THE INVENTION

FIG. 1

Figure 1:
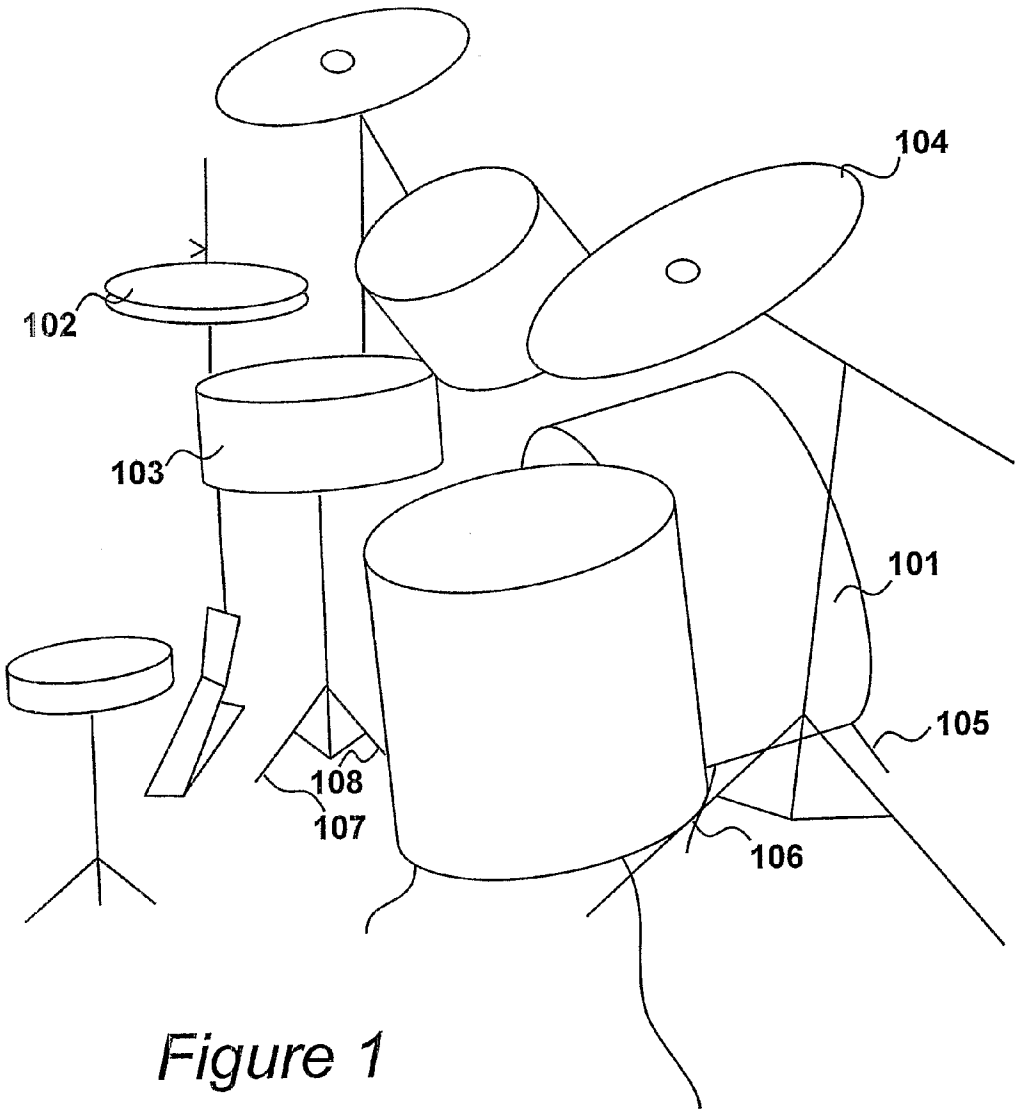
FIG. 1 shows a drum kit.

FIG. 1 shows a drum kit. When a drum kit is being played, drums such as bass drum 101, hi-hat 102, snare drum 103, and crash cymbal 104 are subjected to a significant amount of force. Because of this force exerted, support feet such as feet 105 and 106 of bass drum 101, and feet 107 and 108 of snare drum 103 can cause damage (such as scratching or marking) to the underlying floor. Many drum kits are frequently moved to different performing venues, and it is highly undesirable to cause damage to the floor of any of these venues.

To prevent damage to floors, many drummers currently have a piece of carpet or similar that they transport along with their drum kit to each venue, and place underneath the drum kit to prevent damage. This can be a piece of ordinary household carpet, but specialist drummers carpets are also available.

FIG. 2

Figure 2:
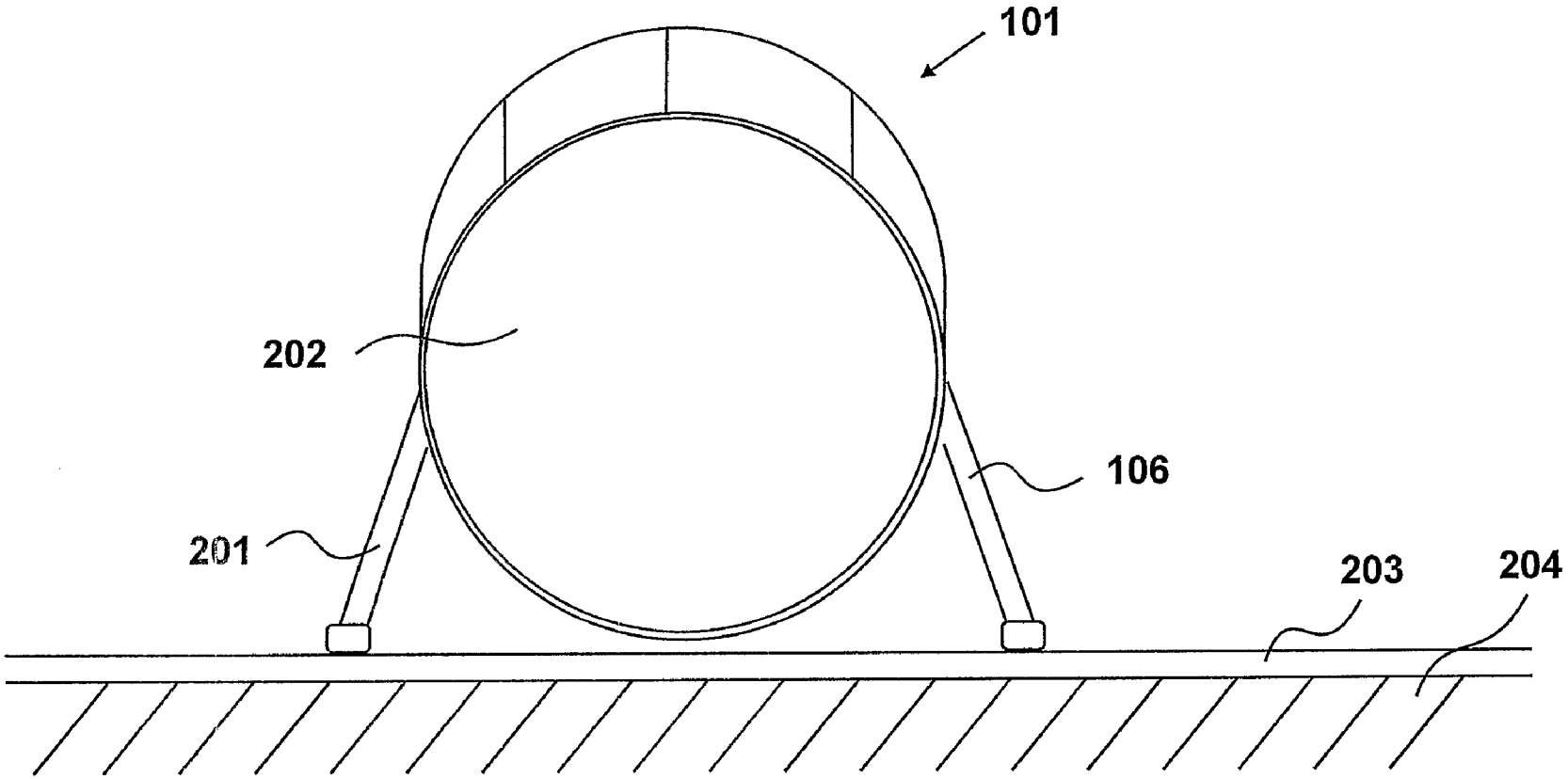
FIG. 2 shows a bass drum.

FIG. 2 shows bass drum 101, and two of its support feet 106 and 201. Bass drum 101 is placed on carpet 203, which protects floor 204. Because a bass drum is generally played with a pedal (as is a hi-hat such as 102) when the pedal is depressed, force is exerted onto the skin 202 of bass drum 101. This force causes bass drum 101 to move away from the drummer. This is known as drum creep, and is a common problem known to drummers.

Whilst carpet 203 prevents damage to floor 204, it does not eliminate drum creep.

FIG. 3

Figure 3:
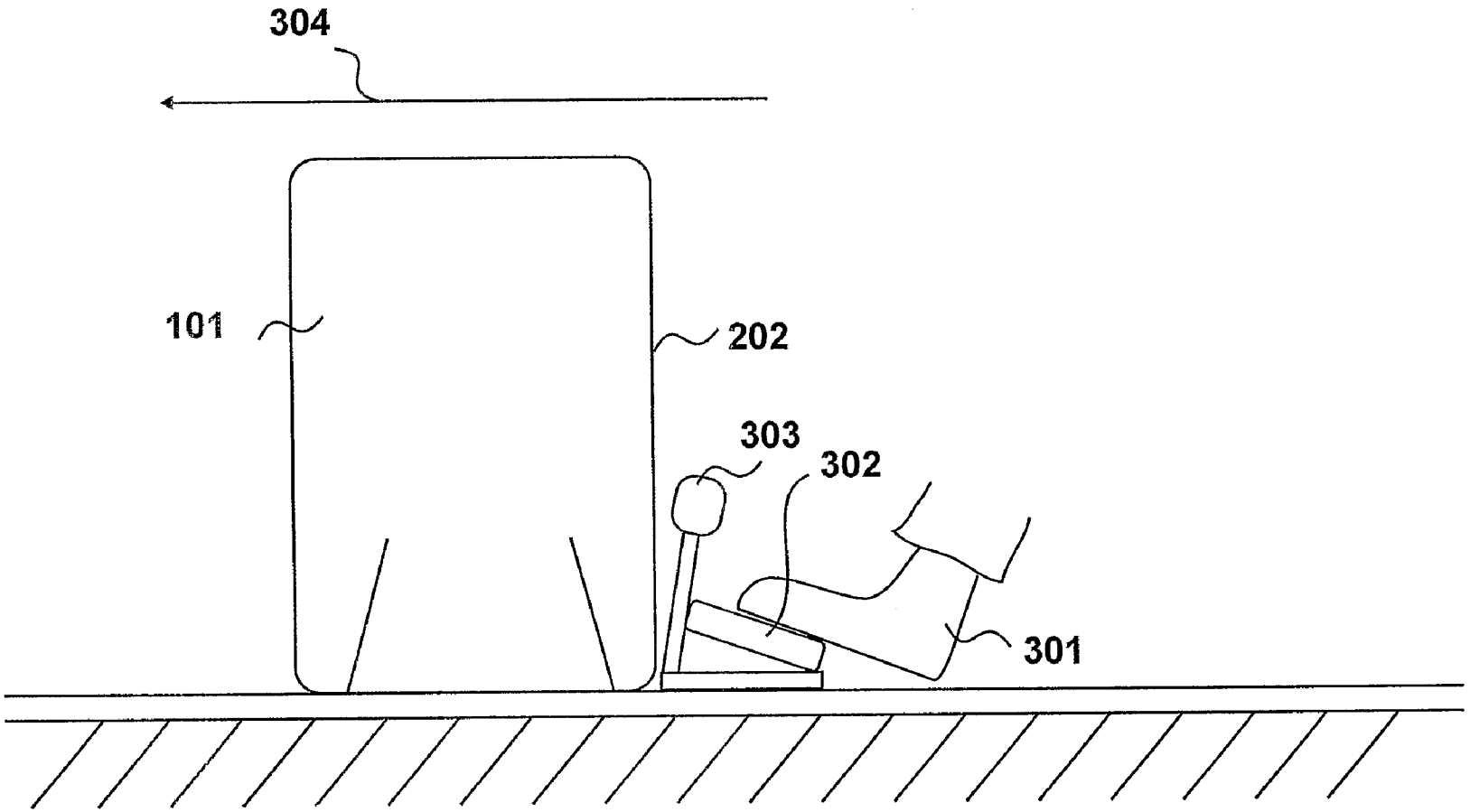
FIG. 3 shows a cross section of a bass drum in use.

FIG. 3 shows a cross section of bass drum 101 in use. When the drummer's foot 301 presses on to pedal 302, mallet 303 hits drum skin 202. This causes a significant force in the direction of arrow 304. This illustrates the problem of drum creep.

FIG. 4

Figure 4:
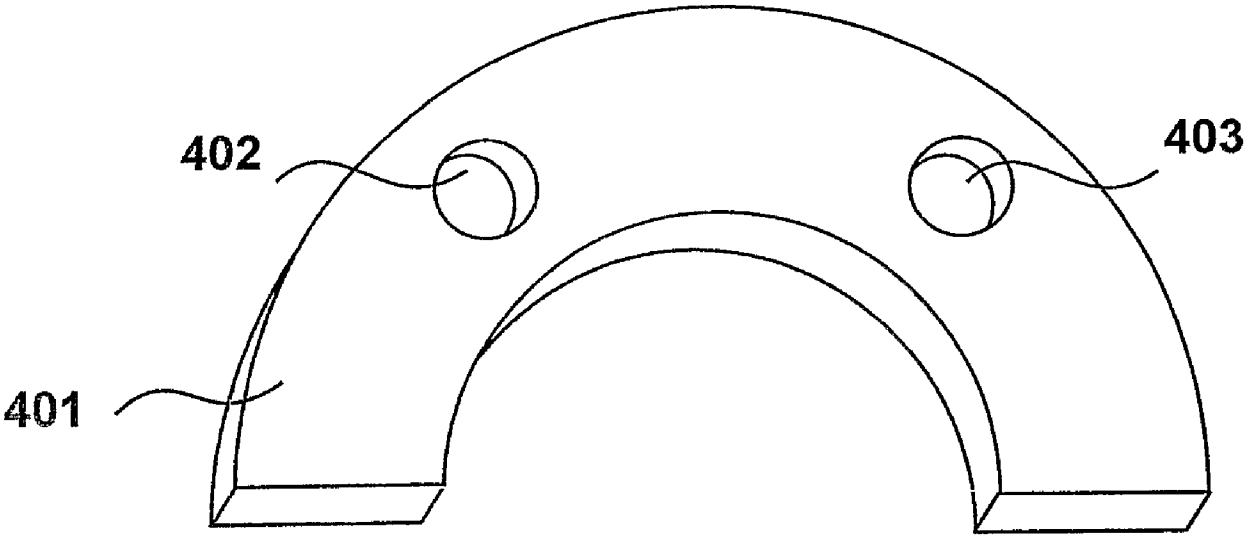
FIG. 4 shows a foot locator.

In order to prevent drum creep, rigid foot locators are provided such as that shown in FIG. 4. Foot locator 401 is, in a preferred embodiment, substantially C-shaped. In a preferred embodiment foot locator 301 is made from a lightweight metal alloy or a strong plastics material. Foot locator 401 has two holes 402 and 403, designed such that each will receive a connector to attach foot locator 401 to a carpet or similar substrate. Foot locators such as 401 are configured to be attached to a carpet such as 203 in order to prevent drum creep, and this is described with reference to FIG. 5 below.

FIG. 5

Figure 5:
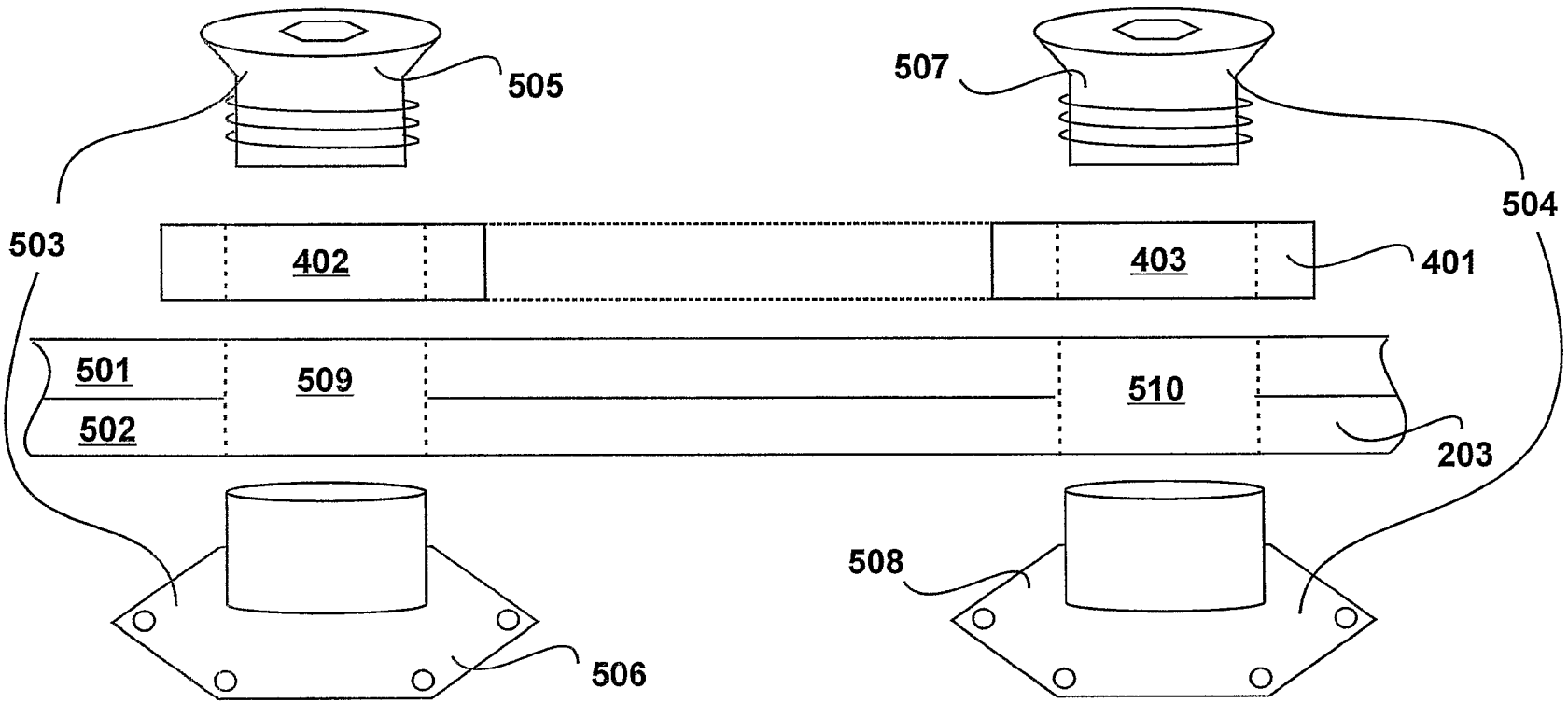

FIG. 5 shows a cross-section through apparatus according to an embodiment of the present invention. Foot locator 401 is shown along with carpet 203 which has an upper surface 501 and an under surface 502. Although in this embodiment substrate 203 is a carpet, it is appreciated that in alternative embodiments a different flexible substrate could be used, such as rubber matting. Foot locator 401 is firmly secured to carpet 203 by, in this embodiment, two connectors 503 and 504.

Connector 503 consists of screw 505 and jet nut 506 and connector 504 consists of screw 507 and jet nut 508. Jet nut 506 is pushed into hole 509 in carpet 203. Screw 505 passes through hole 402 in foot locator 401, and its thread interacts with the thread inside jet nut 506. Similarly, jet nut 508 is pushed into hole 510 in carpet 203 and screw 507 passes through hole 403 in foot locator 401. In a preferred embodiment, holes 509 and 510 in carpet 203 are made using an electric drill.

With jet nuts 506 and 508 in their respective holes 509 and 510, and screws 505 and 507 in holes 402 and 403, screws 505 and 507 can be tightened. In a preferred embodiment, this is done with an Allen key. When screws 505 and 507 are fully tightened, jet nuts 506 and 508 are pulled into carpet 203, such that they compress under surface 502, and therefore do not protrude from the under surface 502 of carpet 203. This is shown in FIG. 6.

FIG. 6

Figure 6:
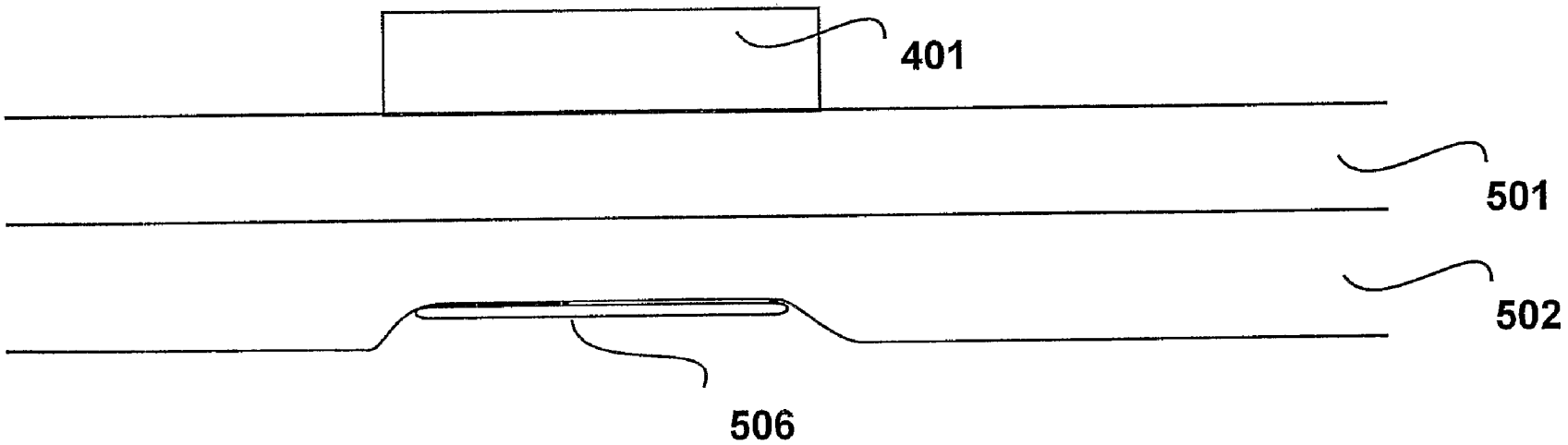
FIG. 6 shows a cross section of a foot locator in position ready for use.

FIG. 6 shows a cross-section of the apparatus according to the present invention, when ready for use. In a preferred embodiment, upper layer 501 of carpet 203 has a soft finish, and under layer 502 has a rubberised, non-slip type surface. Jet nut 506 can be seen to be pulling under layer 502 upwards, towards foot locator 401. Because, in a preferred embodiment, under surface 502 is non-slip, carpet 203 does not move. Also, because jet nut 506 (or indeed any other part of the apparatus), does not protrude from said under surface no part of the apparatus marks or damages the floor below.

In this way, foot locators can be attached to a drummers carpet, and this can be put down in any location without concern about damaging the floor.

FIG. 7

Figure 7:
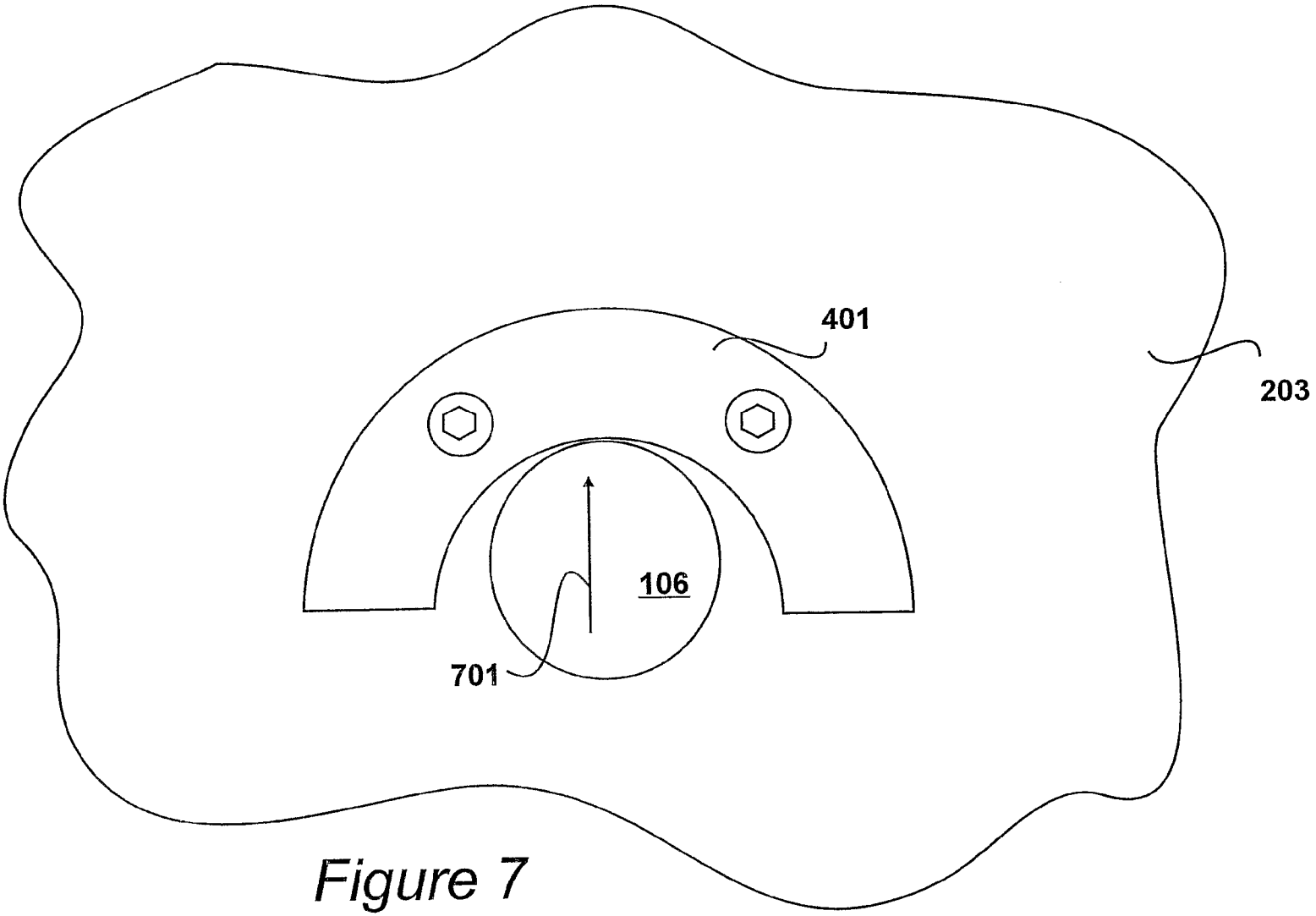
FIG. 7 shows a plan view of a foot locator fixed to a carpet.

FIG. 7 shows a plan view of foot locator 401 fixed to carpet 203. Support foot 106 is shown located within foot locator 401. Because foot locator 401 is secured firmly to carpet 203, when a force (shown by arrow 701) is exerted on support foot 106, as a result of bass drum 101 being played, foot locator 401 prevents backward movement of the supported drum 101. Therefore this apparatus eliminates drum creep.

FIG. 8

Figure 8:
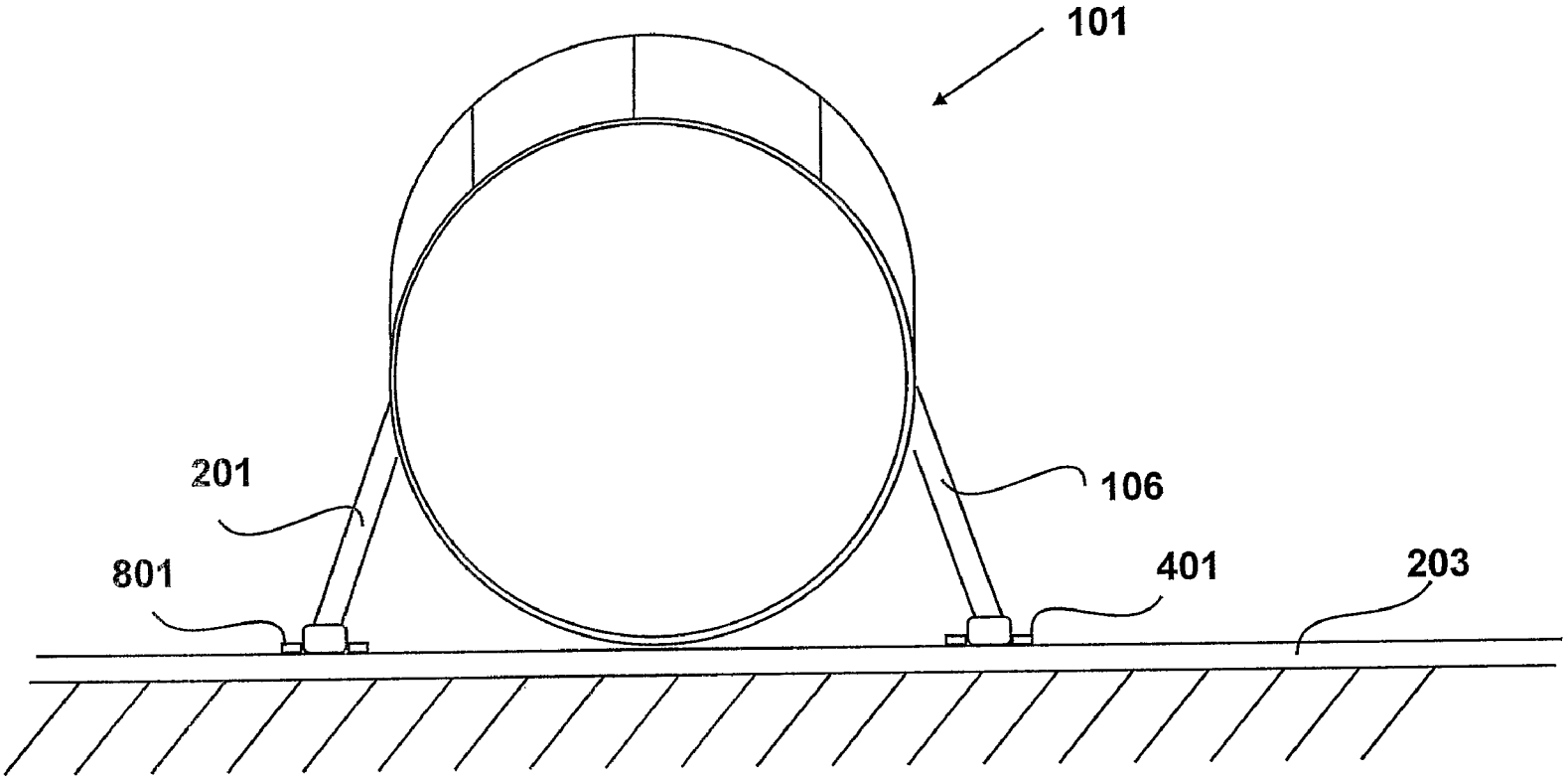
FIG. 8 shows a bass drum with foot locators in position.

FIG. 8 shows a front view of bass drum 101 on carpet 203, with two. foot locators 401 and 801 in position behind support feet 106 and 201 respectively.

FIG. 9

Figure 9:
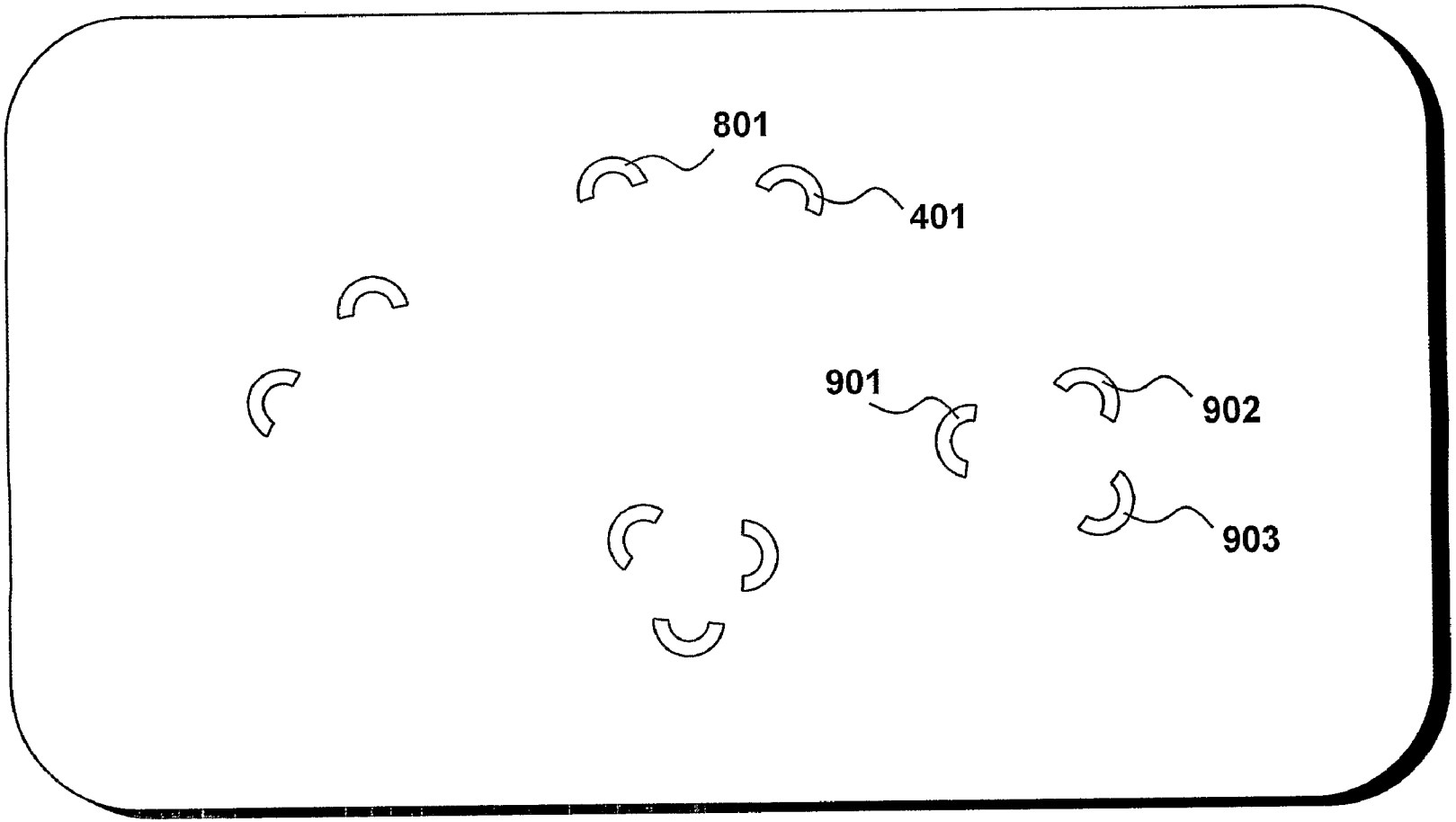
FIG. 9 shows a carpet with a number of foot locators positioned across it.

FIG. 9 shows a carpet, such as carpet 203, with a number of foot locators positioned across it.

Every drummer has their own configuration of drum kit which they prefer to play with. Because foot locators such as 401 are, in a preferred embodiment, permanently attached to carpet 203, their position represents the configuration of drums for a particular performer. For example, the position of foot locators 801 and 401 specify the location for bass drum 101. In addition, foot locators 901, 902 and 903 could, for example, define the location for snare drum 103.

In order to assemble apparatus as shown in FIG. 8, a performer would first set up his drum kit, on the carpet, into his preferred configuration. The positions of support feet such as feet 105, 106, 107 and 108 would then be marked onto carpet 203. From these markings, a foot locator would be positioned at each marked location and secured into position. In this embodiment, this is achieved by drilling a hole through the carpet for each connector, then fixing the locator to the carpet with the connectors.

In the present embodiment, foot locators such as 401, 801, 901, 902 and 903 are made from a material to co-ordinate with the drum kit. However, in an alternative embodiment, each of the foot locators could be colour-coded. This could mean for example, that locators 801 and 401 were coded in purple, whilst locators 901, 902 and 903 could be coded in pink. Support feet 106 and 201 of bass drum 101 could therefore also be coded in purple so as to match with locators 801 and 401. Similarly, support feet 107 and 108 of snare drum 103 could be coded in pink to co-ordinate with locators 901, 902 and 903. Alternatively, the pieces of drum kit may not be colour-co-ordinated, but a list may be provided stating for example that the bass drum location is defined by purple locators and the snare drum location is defined by pink locators.

FIG. 10

Figure 10:
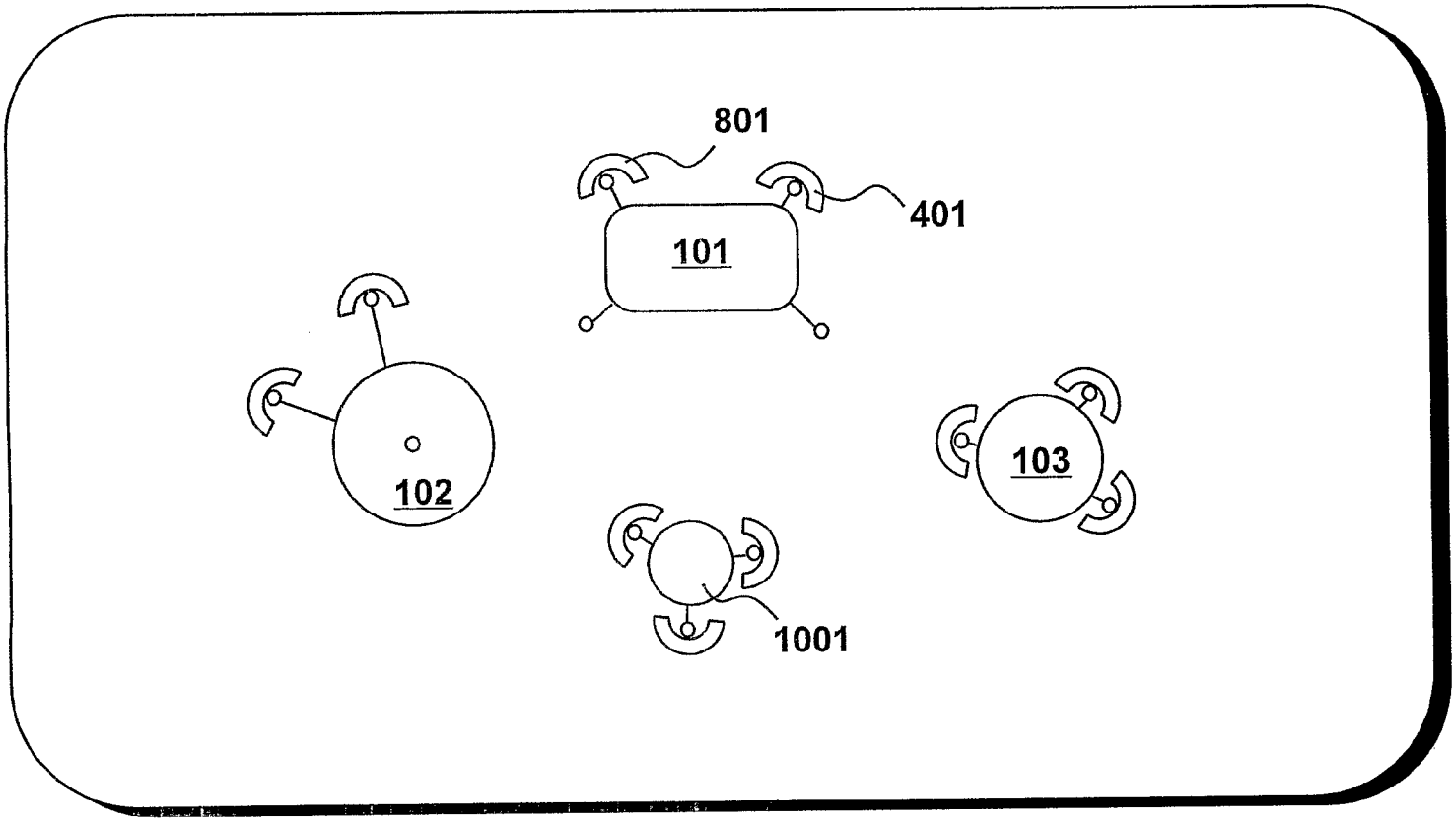
FIG. 10 shows a similar view to FIG. 9, with the addition of some drums.

FIG. 10 shows a similar view to FIG. 9, with the addition of some drums placed into position. Bass drum 101 has been located so that its support feet 201 and 106 are positioned inside locators 801 and 401. Similarly, snare drum 103, hi-hat 102 and drummer's stool 1001 are positioned with their respective locators.

A further advantage of the present invention is therefore that once the locators have been secured to the carpet, very little skill is required in order to set up the drum kit into the performer's own preferred configuration. The carpet, with locators attached, is simply laid on the floor and then the drums are fitted in according to the positions of the foot locators. This significantly reduces set up time for the drummer, and is therefore a very efficient method. It also allows an unskilled assistant to set up the drums on behalf of the drummer.

The invention claimed is:

1. Apparatus for covering a floor in order to place a drum or a plurality of drums (a drum kit) on said floor, said apparatus comprising:

a flexible substrate having an upper surface and an under surface for covering a region of a floor onto which a drum is to be assembled such that a plurality of support feet contact the upper surface of said substrate;

a plurality of rigid foot locators extending from said upper surface, each at a desired location for a specific one of said support feet, wherein said foot locators are secured firmly to the substrate by jet nut and screw connectors without fixtures that protrude from said under surface so as not to cause floor damage; and the foot locators restrict movement of the support feet, thereby restricting movement of a supported drum while said drum is being played.

2. Apparatus according to claim 1, wherein said substrate is a fabric material.

3. Apparatus according to claim 2, wherein said substrate is a carpet.

4. Apparatus according to claim 1, wherein said under surface is resistant to sliding over a floor, without marking or damaging said floor.

5. Apparatus according to claim 1, wherein said foot locators are substantially C-shaped.

6. Apparatus according to claim 5, wherein said C-shaped foot locators are positioned such that a support foot is receivable through the opening defined by the C-shape and the opposite side of a C-shaped locator restricts movement of a located support foot while the drums are being played.

7. Apparatus according to claim 1, wherein said foot locators are fabricated from a light-weight metal alloy or a strong plastics material.

8. Apparatus according to claim 1, wherein said foot locators are colour-coded to facilitate the identification of the correct desired locations.

9. Apparatus according to claim 1, wherein the foot locators are firmly secured to the substrate by a connector or plurality of connectors that each extend through a hole in said substrate.

10. Apparatus according to claim 1, wherein the connector is pulled into the under surface of the substrate, such that the connector does not contact with the floor below.

11. A method of providing floor coverings for assembling a drum kit such that support feet are positioned at desired locations, comprising the steps of:

laying a flexible substrate on a floor, wherein said substrate has an upper surface and an under surface, a plurality of rigid foot locators extend from said upper surface, and said foot locators are secured firmly to said substrate with jet nut and screw connectors without fixtures that protrude from said under surface so as not to cause floor damage;

assembling drum supports that have support feet and inserting one or more of said support feet into a prespecified one of said foot locators, such that said foot locators restrict movement of said support feet and thereby restrict movement of a supported drum while the drum is being played.

12. A method according to claim 11, wherein said insertion of support feet into a pre-specified one of said foot locators is achieved by matching the colour of foot locator to the support feet of the appropriate drum.

13. A method of providing a floor covering for use when playing drums, comprising the steps of:

assembling a set of drums or drum kit into a desired configuration for playing;

recording the position of one or more support feet resting on a floor;

marking the location of one or more of said drum feet on a substrate having an upper and a lower surface to produce marked locations;

positioning a foot locator at each of said marked locations so that each said locators extends from said upper surface; and securing each locator to said substrate using a jet nut and screw connector fixture that does not protrude from said under surface so as not to cause floor damage.

* * * * *